US008605902B1

(12) United States Patent
Thommana et al.

(10) Patent No.: US 8,605,902 B1
(45) Date of Patent: Dec. 10, 2013

(54) METHOD AND IMPLEMENTATION FOR SUPPORTING SWITCHABLE RED SIDE OR BLACK SIDE CONTROL OPTIONS FOR AIRBORNE RADIO COMMUNICATION RADIOS

(75) Inventors: John Thommana, Cedar Rapids, IA (US); Roy C. Moore, Cedar Rapids, IA (US); Terry A. Shaner, Marion, IA (US); Lizy Paul, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 1206 days.

(21) Appl. No.: 12/456,724

(22) Filed: Jun. 22, 2009

(51) Int. Cl.
*H04K 1/00* (2006.01)

(52) U.S. Cl.
USPC ..... 380/255; 713/189

(58) Field of Classification Search
USPC ..... 380/270; 713/100, 189
See application file for complete search history.

(56) References Cited

U.S. PATENT DOCUMENTS

| | | | | |
|---|---|---|---|---|
| 7,370,210 | B2 * | 5/2008 | Symes | 713/189 |
| 7,487,367 | B2 * | 2/2009 | Belnet et al. | 713/194 |
| 7,509,141 | B1 * | 3/2009 | Koenck et al. | 455/552.1 |
| 7,835,523 | B1 * | 11/2010 | Mickelson et al. | 380/255 |
| 7,849,311 | B2 * | 12/2010 | Donlin et al. | 713/164 |
| 7,885,409 | B2 * | 2/2011 | Jakoubek et al. | 380/255 |
| 7,904,711 | B2 * | 3/2011 | Mackey et al. | 713/151 |
| 7,937,076 | B2 * | 5/2011 | Zeller et al. | 455/418 |
| 2004/0052372 | A1 * | 3/2004 | Jakoubek | 380/255 |
| 2008/0196081 | A1 * | 8/2008 | Hajji et al. | 726/1 |

* cited by examiner

*Primary Examiner* — Linglan Edwards
(74) *Attorney, Agent, or Firm* — Donna P. Suchy; Daniel M. Barbieri

(57) ABSTRACT

The present invention is directed to a radio system for providing dynamic switching between red side control functionality and black side control functionality. The system may include a control processor configured for providing the black side control functionality. The system may also include a protected core processor configured for providing the red side control functionality. The system may further include a switch configured for selectively connecting external control elements to the control processor and/or the protected core processor for allowing the control processor and/or the protected core processor to control the external control elements.

13 Claims, 4 Drawing Sheets

METHOD AND IMPLEMENTATION FOR SUPPORTING SWITCHABLE RED SIDE OR BLACK SIDE CONTROL OPTIONS FOR AIRBORNE RADIO COMMUNICATION RADIOS

FIELD OF THE INVENTION

The present invention relates to the field of software-defined radio (SDR), (including waveforms) and particularly to method(s) and implementation(s) for supporting switchable red side or black side control options for Airborne Radio Communication radios.

BACKGROUND OF THE INVENTION

A number of currently available software-defined radios/methods for implementing software-defined radios may not provide desired results.

Thus, it would be desirable to provide software-defined radios/methods for implementing software-defined radios which obviate the above-referenced problems associated with currently available solutions.

SUMMARY OF THE INVENTION

Accordingly, an embodiment of the present invention is directed to a method for providing dynamic switching between red side control functionality and black side control functionality for a radio system, said method including: providing a message from black side control elements of the radio system to a black side human machine interface digital signal processor, said message including a mode change request; directing a communication, via a low voltage differential signaling interface, from the black side human machine interface digital signal processor to a protected core processor, the protected core processor being configured for hosting the red side control functionality, the communication informing the protected core processor of the mode change request; sending a control transfer message, via a cryptographic sub-system, from the protected core processor to the black side human machine interface digital signal processor; and switching the black side control elements, wherein switching the black side control elements includes disconnecting the black side control elements from the black side human machine interface digital signal processor and connecting the black side control elements and the protected core processor via the low voltage differential signaling interface.

A further embodiment of the present invention is directed to a computer program product including: a signal-bearing medium bearing one or more instructions for performing a method for providing dynamic switching between red side control functionality and black side control functionality for a radio system, said method including: providing a message from external black side control elements of the radio system to a black side human machine interface digital signal processor, said message including a mode change request; directing a communication, via a low voltage differential signaling interface, from the black side human machine interface digital signal processor to a protected core processor, the protected core processor being configured for hosting the red side control functionality, the communication informing the protected core processor of the mode change request; sending a control transfer message, via a cryptographic sub-system, from the protected core processor to the black side human machine interface digital signal processor; and switching the external black side control elements, wherein switching the external black side control elements includes disconnecting the external black side control elements from the black side human machine interface digital signal processor and connecting the external black side control elements and the protected core processor via the low voltage differential signaling interface.

An additional embodiment of the present invention is directed to a radio system for providing dynamic switching between red side control functionality and black side control functionality, including: a control processor configured for providing the black side control functionality; a protected core processor configured for providing the red side control functionality; and a switch configured for selectively connecting external control elements to one of: the control processor and the protected core processor for allowing one of: the control processor and the protected core processor to control the external control elements.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

A number of aircrafts are wired for either black side control or red side control of a tactical radio. An exemplary Airborne Radio Communication radio may have only black side control as all the platforms on which it has been hosted may only have black side control. The next generation of Airborne Radio Communication radios may host modern networking waveforms like Mobile User Objective System (MUOS) and Soldier Radio Waveform (SRW) waveforms. These waveforms typically mandate red side control architecture for the radios hosting them. Newer aircrafts are being wired only for red control and some aircrafts may have the capability of supporting either a red side or black side control. A number of Airborne Radio Communication radios are extremely Size Weight and Power (SWAP)-controlled and adding dual control architecture will incur a huge penalty in terms of power and size due to duplication of control (processors, memory, storage and I/O). The requirement to support modern tactical networking waveforms may place the requirement to support red side control on a number of Airborne Radio Communication radios.

Moving control from black side to red side may require platform wiring changes on nearly all of the one hundred-eighty platforms that currently host software-defined radios (ex.—airborne radio communication radios). However, in order to: a.) maintain backward compatibility; b.) minimize platform upgrade costs/reduce platform integration costs; c.) operate on platforms having red side control; and d.) obtain National Security Agency (NSA) approval; the airborne radio communication radios may be required to support black side control as well as red side control. Thus, the present invention presents multiple approaches which permit selectable red side control or black side control. Further, the present invention solves a number of the above-referenced problems by providing a system/method for providing a dynamically-switchable control mechanism for selecting red side control options and/or black side control options.

Figure 1:
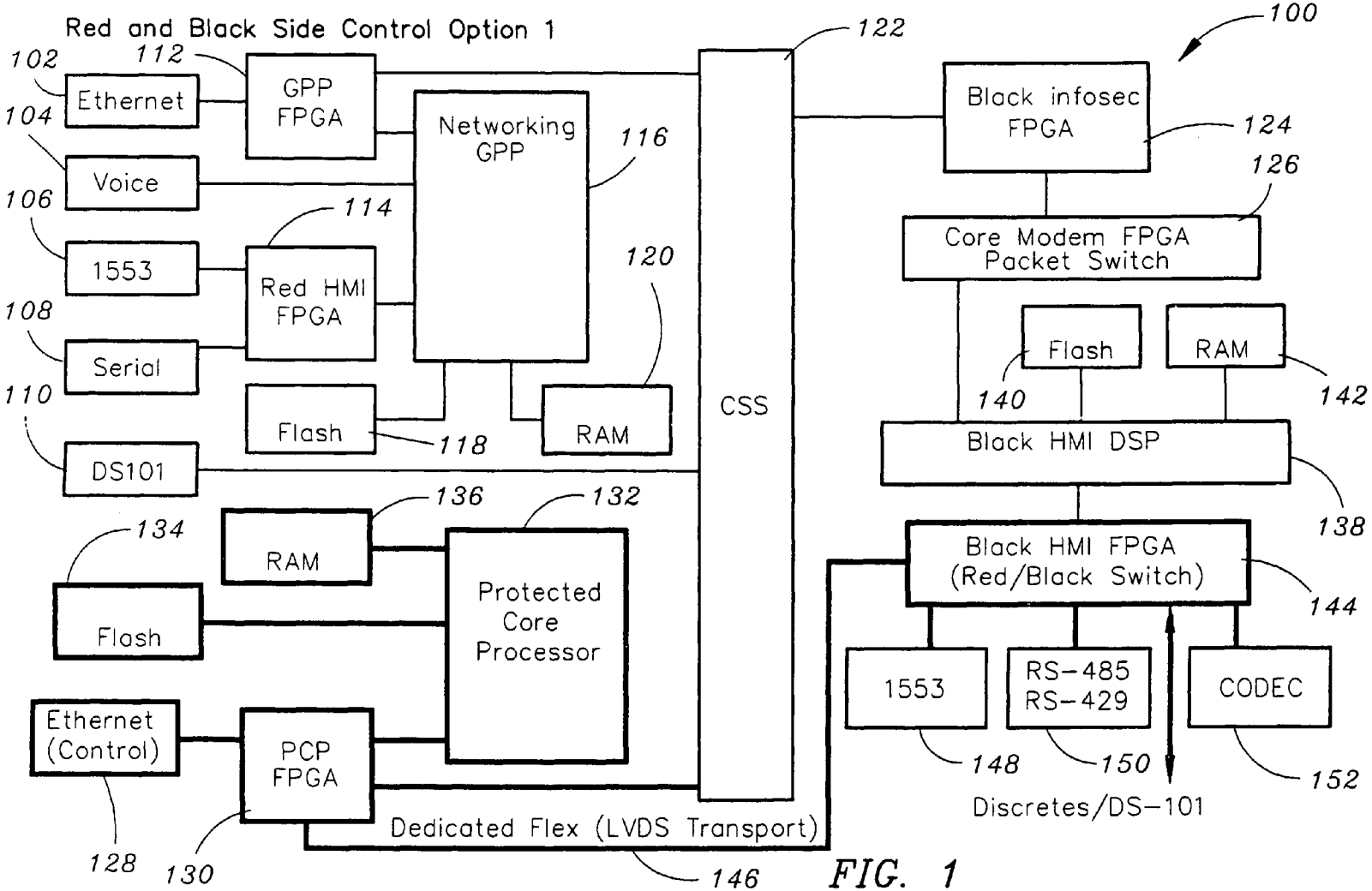
FIG. 1 is a block diagram illustrating a system for supporting switchable red side control options and/or black side control options/a system for providing dynamic switching between red side control options and black side control options in accordance with an exemplary embodiment of the present invention.

Referring to FIG. 1, a block diagram illustrating a system for supporting switchable red side control options and/or black side control options/for providing dynamic switching between red side control options and black side control options for a radio in accordance with an exemplary embodiment of the present invention is shown. For example, the system 100 may be/may include a software-defined radio module/transceiver/architecture, such as an Airborne Radio Communication Black Human Machine Interface (HMI) and Information Security (INFOSEC) module or other variants. In exemplary embodiments, the system 100 may include a plurality of input/output (I/O) ports, such as an Ethernet port 102, a voice port 104, a 1553 port 106, a serial port 108, and a DS-101 port 110. The system 100 may further include a General Purpose Processor Field Programmable Gate Array (GPP FPGA) 112, the GPP FPGA 112 being connected to the Ethernet port 102. In further embodiments, the system 100 may further include a Red Human Machine Interface Field Programmable Gate Array (Red HMI FPGA) 114, said Red HMI FPGA 114 being connected to the 1553 port 106 and the serial port 108.

In current embodiments of the present invention, the system 100 may further include a Networking General Purpose Processor (Networking GPP) 116. Further, the Networking GPP 116 may be connected to/may include associated memory such as Flash Memory 118 and Random Access Memory (RAM) 120. Still further, the Networking GPP 116 may be connected to: the Ethernet port 102 (via the GPP FPGA 112); the voice port 104; the 1553 port 106 (via the Red HMI FPGA 114); and the serial port 108 (via the Red HMI FPGA 114).

In exemplary embodiments of the present invention, the system 100 may further include a Cryptographic Sub-System (CSS) 122. The CSS 122 may be connected to the: the Ethernet port 102 (via the GPP FPGA 112); and the DS-101 port 110. Further, the system 100 may include a Black Information Security Field Programmable Gate Array (Black Infosec FPGA) 124, the Black Infosec FPGA 124 being connected to the CSS 122. Still further, the system 100 may include a Core Modem Field Programmable Gate Array Packet Switch (Core Modem FPGA Packet Switch) 126, the Core Modem FPGA Packet Switch 126 being connected to the Black Infosec FPGA 124.

In current embodiments of the present invention, the system 100 may further include a Control Ethernet Port 128. The system 100 may further include a Protected Core Processor Field Programmable Gate Array (PCP FPGA) 130, the PCP FPGA 130 may be configured for being connected to the Control Ethernet Port 128. In further embodiments, the system 100 may include a Protected Core Processor (PCP) 132. The PCP 132 may be connected to/may include associated memory such as Flash Memory 134 and Random Access Memory (RAM) 136. Further, the PCP 132 may be configured for being connected to the Control Ethernet Port 128 (via the PCP FPGA 130). Still further, the PCP FPGA 130 is configured for being connected to the CSS 122.

In exemplary embodiments of the present invention (as shown in FIG. 1), the system 100 may further include a Black Human Machine Interface Digital Signal Processor (Black HMI DSP) 138. The Black HMI DSP/Black side HMI DSP 138 may be connected to/may include associated memory such as Flash Memory 140 and Random Access Memory (RAM) 142. The Black HMI DSP 138 may be configured for being connected to the Core Modem FPGA Packet Switch 126. In further embodiments, the system 100 may include a Black Human Machine Interface Field Programmable Gate Array (Black HMI FPGA) 144. The Black HMI FPGA/Black side HMI FPGA 144 may be configured for being connected to/included in the Black HMI DSP 138. The Black HMI FPGA 144 may be further configured for being connected to the PCP FPGA 130 via a Dedicated Flex/Low Voltage Differential Signaling (LVDS) link/LVDS Transport/LVDS interface 146. In further embodiments, the system 100 may include/may be connected to a plurality of black side control elements/external black side control elements/external control interfaces, such as a Mission Computer (over Black 1553 port (148)), a Remote Control Unit (RCU) (over RS-485 port (150)), and/or the like. For example, the external control interfaces may be configured for being connected to/switched by the Black HMI DSP 138/Black HMI FPGA 144 (ex.—the Red/Black Switch 144). In further embodiments, the system 100 may include a coder/decoder (CODEC)/CODEC interface 152, which may be configured for being connected to the Black HMI FPGA 144.

As mentioned above, the system 100 of the present invention may support/may include red side control functionality/red side control and black side control functionality/black side control such that either red side control or black side control may be selectable (ex.—dynamically selectable) in the system 100. In the system 100 shown in FIG. 1, red side control may be supported over the Control Ethernet port 128. Further, the protected core processor (PCP) 132, with its associated RAM 136 and Flash Memory 134 may be configured for hosting the red side control functionality of the system 100. In exemplary embodiments, the PCP 132 may be a dedicated protected core processor and may be configured for being the main control processor of the system 100.

In exemplary embodiments, in order to support legacy waveforms and black side control functionality/black side control on platforms, the system 100 of the present invention is configured such that the black side control elements/external black side control elements may be switched at the Black HMI FPGA 144, such that said external black side control elements may be controlled by either the protected core processor 132 or the Black HMI processor 138. When red side control over the control Ethernet port 128 is supported, the system 100 may be configured for disconnecting the black side control elements (ex.—Mission Computer and RCU) from both the protected core processor 132 and the Black HMI Processor 138.

In current embodiments of the present invention, when the system 100 is powered up (ex.—on power up/upon power up of the system 100), if red side control (ex.—red side control via the control Ethernet port 128) is disabled, and if legacy waveforms are being executed by the system 100, the system 100 may be configured to operate in a first mode/first operating mode (Mode 1). When the system 100 is operating in a Mode 1, the PCP 132 is the control master, thus all of the black side control elements may be controlled by the PCP 132. Further, in Mode 1, the Black HMI DSP 138 is the control slave. In Mode 1, the PCP 132 may send a control transfer message via the CSS 122 to the Black HMI DSP 138. In Mode 1, the Black HMI DSP 138 may become black side control processor. In Mode 1, the Black HMI DSP 138 may be configured for switching the control interfaces/the black interfaces/the external control interfaces/the black side control elements/the external black side control elements to the Black HMI DSP 138 and may be further configured for disconnecting the control interfaces from the PCP 132 (ex.—disconnecting the control interfaces from the LVDS link 146 to the PCP 132). When the system 100 is in Mode 1, the Black HMI DSP may handle control/provide black side control functionality in a manner similar to how it would do so when implemented in legacy systems.

In exemplary embodiments, when the system 100 is powered up (ex.—on power up/upon power up of the system 100), if red side control (ex.—red side control via the control Ethernet port 128) is disabled, and if networking waveforms are being executed by the system 100 which require red side control over the black interfaces, the system 100 may be configured to operate in a second mode/second operating mode (Mode 2). When the system 100 is operating in Mode 2, the PCP 132 is the control master, thus all of the black side control elements may be controlled by the PCP 132. When the system 100 is operating in Mode 2, the PCP 132 may send a low power mode message via the CSS 122 to the Black HMI DSP 138. Further, in Mode 2, the Black HMI DSP 138 of the system 100 is the control slave and goes into low power operation mode. Further, when the system 100 is in Mode 2, the PCP 132 may initiate authentication with the black side control element(s) (ex.—Mission Computer and/or RCU) over the LVDS interface 146, if configured. Further, in Mode 2, the PCP 132 and RCU/Mission Computer may initiate encrypted communication mode over the LVDS interface 146, if configured.

In current embodiments of the present invention, when the system 100 is powered up (ex.—on power up/upon power up of the system 100), if red side control/red side control Ethernet port (ex.—red side control via the control Ethernet port 128) is enabled, the system 100 may be configured to operate in a third mode/third operating mode (Mode 3). When the system 100 is operating in Mode 3, the PCP 132 is the control master, thus all of the black side control elements may be controlled by the PCP 132. Further, in Mode 3, the Black HMI DSP 138 of the system 100 is the control slave. When the system 100 is operating in Mode 3, the PCP 132 may send a control transfer message via the CSS 122 to the Black HMI DSP 138. In Mode 3, the Black HMI DSP 138 may disconnect the external black side control elements (ex.—RCU, Mission Computer, etc.) from both the Black HMI DSP 138 and the PCP 132. Further, in Mode 3, the Black HMI DSP of the system 100 may go into low power operation mode.

As mentioned above, the system 100 of the present invention may be configured for dynamically switching between red side control options and black side control options. For example, the system 100 may be configured for switching between the above-mentioned modes. For instance, when switching from legacy mode (Mode 1) to networking mode (Mode 2), the Black HMI DSP 138 of the system 100 may be configured for receiving a mode change message from the external black side control element(s) (ex.—RCU and/or Mission Computer). Further, the Black HMI DSP 138 may communicate to the PCP 132 regarding/may inform the PCP 132 of the mode change message/request via the LVDS interface 146. Further, the PCP 132 may send a control transfer message via the CSS 122 to the Black HMI DSP 138. Still further, the Black HMI DSP 138 may switch/disconnect the external black side control element(s)/external control interface(s) from the Black HMI DSP 138 and may switch/connect the external control interface(s) to the PCP 132 via the LVDS interface 146. Further, the Black HMI DSP 138 may then go into low power operation mode and the PCP 132 may initiate authentication with the external control elements (ex.—RCU and/or Mission Computer) over/via the LVDS interface 146, if configured. Still further, the PCP 132 of the system 100 and the external control elements (ex.—RCU and/or Mission Computer) may initiate encrypted communication mode over the LVDS interface 146, if configured.

Alternatively, when switching from networking mode (Mode 2) to legacy mode (Mode 1), the PCP 132 of the system 100 may receive a mode change message from the external control element(s) (ex.—RCU and/or Mission Computer). Further, the PCP 132 may send a control transfer message via the CSS 122 to the Black HMI DSP 138. Further, the Black HMI DSP 138 may become black side control processor. Still further, the Black HMI DSP 138 may switch (ex.—connect) the external control interfaces to the Black HMI DSP 138 and may switch/disconnect the external control interfaces from the LVDS link 146 to the PCP 132 (ex.—may disconnect the external control interfaces from the PCP 132). Further, the Black HMI DSP 138 of the system 100 may handle control/provide black side control functionality in a manner similar to how it would do so when implemented in legacy systems.

Figure 2:
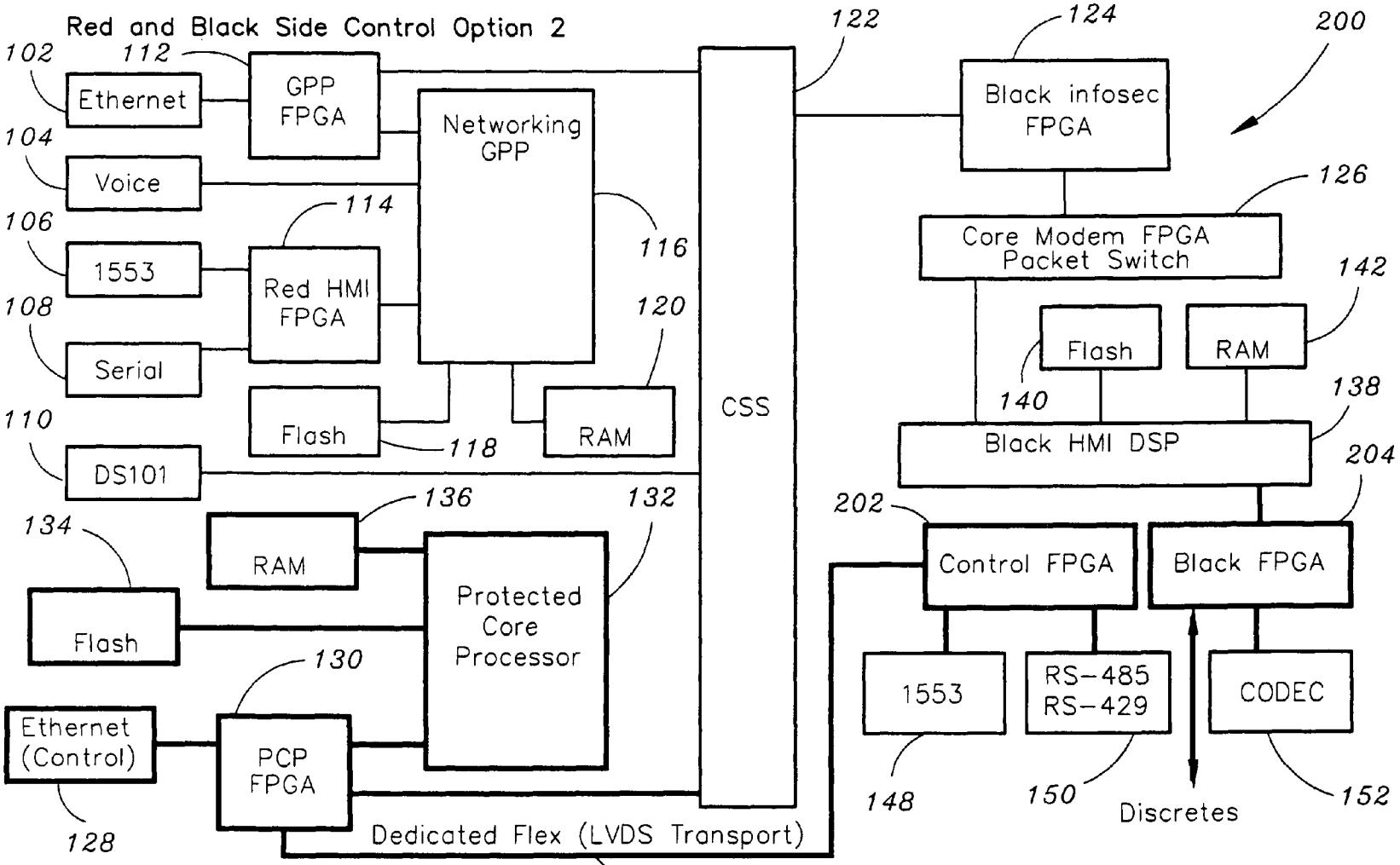
FIG. 2 is block diagram illustrating a system for supporting switchable red side control options and/or black side control options in accordance with an alternative exemplary embodiment of the present invention.

Referring to FIG. 2, a system for supporting red side control options and/or black side control options/for providing dynamic switching between red side control options and black side control options for a radio in accordance with an alternative exemplary embodiment of the present invention is shown. The system 200 shown in FIG. 2 (Option 2) may be similar to the system 100 of FIG. 1 (Option 1) described above, however, the system 200 shown in FIG. 2 may differ in a number of respects. In the system 200 shown in FIG. 2, the PCP 132 may be configured for/may be responsible for providing both red side control and black side control. The system 200 may include a Control Field Programmable Gate Array (Control FPGA) 202 and a Black Field Programmable Gate Array 204 (Black FPGA). The Control FPGA 202 may be configured for being connected to the PCP FPGA 130 via the LVDS Transport 146. The Black FPGA 204 may be configured for being connected to the Black HMI DSP 138. Further, in the system 200 shown in FIG. 2, the external control interfaces may be configured for being connected to the Control FPGA 202, while the CODEC/CODEC interface 152 may be configured for being connected to the Black FPGA 204. Further, for the system 200 shown in FIG. 2, software needed to support legacy mode black side control may be ported to the PCP 132 from the Black HMI DSP 138. Still further, for the system 200 shown in FIG. 2, the Black HMI DSP 138 may be configured for performing additional duties such as controlling the discrete I/O and performing black side audio retransmit (which are not control functions). Further, the Black HMI DSP 138 of the system 200 shown in FIG. 2 may be configured for only performing non-control related tasks. The system 200 shown in FIG. 2 may provide a clean design approach and a secure design approach since said system 200 does not include control switching, thereby avoiding a probable cause for malfunction.

Figure 3A:
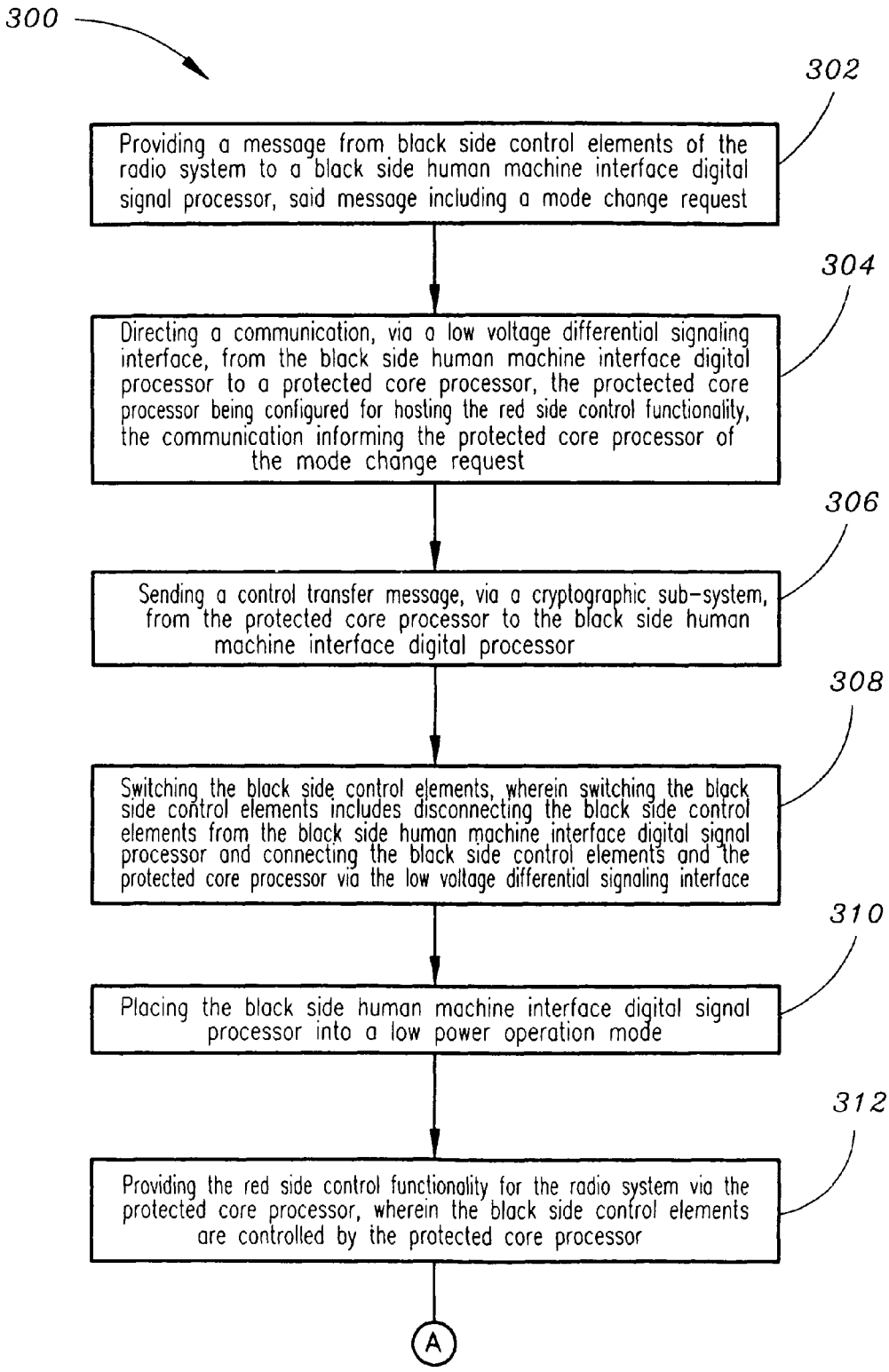
FIGS. 3A and 3B depict a flowchart illustrating a method for providing dynamic switching between red side control functionality and black side control functionality for a radio system in accordance with an exemplary embodiment of the present invention.
Figure 3B:
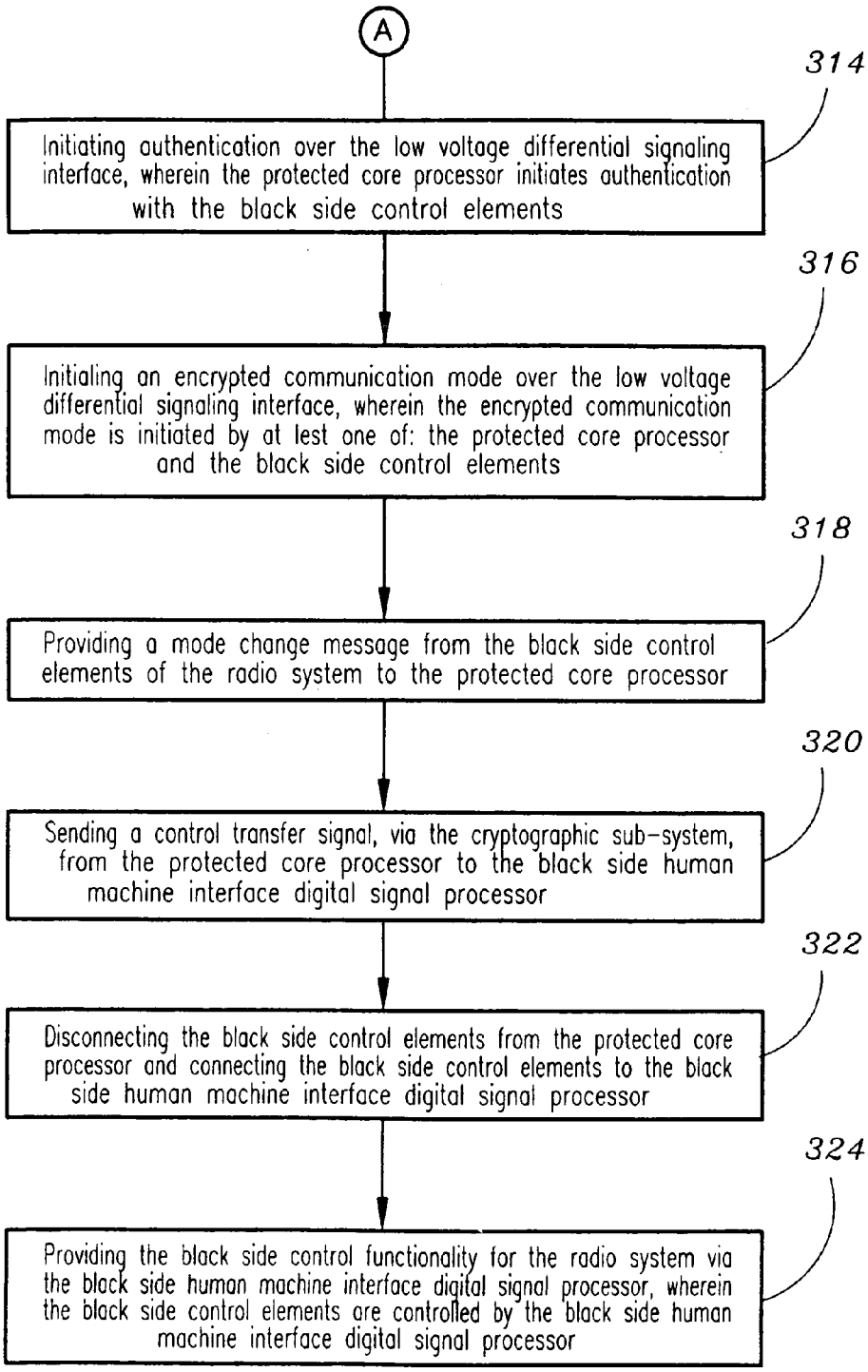

Referring to FIGS. 3A and 3B, a flowchart illustrating a method for providing dynamic switching between red side control options/red side control functionality and black side control options/black side control functionality for a radio/radio system, such as an Airborne Radio Communication radio system, (such as for the system 100 shown in FIG. 1) is shown. The method 300 may include the step of providing a message from black side control elements (ex.—external black side control elements) of the radio system to a black side human machine interface digital signal processor (ex.—Black HMI DSP), said message including a mode change request 302. The method 300 may further include the step of directing a communication, via a low voltage differential signaling interface, from the black side human machine interface digital signal processor to a protected core processor, the protected core processor being configured for hosting the red side control functionality, the communication informing the protected core processor of the mode change request 304. The method 300 may further include the step of sending a control transfer message, via a cryptographic sub-system, from the protected core processor to the black side human machine interface digital signal processor 306. The method 300 may further include the step of switching the external black side control elements, wherein switching the external black side control elements includes disconnecting the external black side control elements from the black side human machine interface digital signal processor and connecting the external black side control elements and the protected core processor via the low voltage differential signaling interface 308. In current embodiments of the present invention, this switching step (308) may be performed by the black side human machine interface digital signal processor.

In exemplary embodiments of the present invention, the method 300 may further include placing the black side human machine interface digital signal processor into a low power operation mode 310. The method 300 may further include providing the red side control functionality for the radio system via the protected core processor, wherein the external black side control elements are controlled by the protected core processor 312. The method 300 may further include initiating authentication over the low voltage differential signaling interface, wherein the protected core processor initiates authentication with the external black side control elements 314. The method 300 may further include initiating an encrypted communication mode over the low voltage differential signaling interface, wherein the encrypted communication mode is initiated by at least one of: the protected core processor and the external black side control elements 316.

In further embodiments, the method 300 may further include providing a mode change message from the external black side control elements of the radio system to the protected core processor 318. The method 300 may further include sending a control transfer signal, via the cryptographic sub-system, from the protected core processor to the black side human machine interface digital signal processor 320. The method 300 may further include disconnecting the external black side control elements from the protected core processor and connecting the external black side control elements to the black side human machine interface digital signal processor 322. The method 300 may further include providing the black side control functionality for the radio system via the black side human machine interface digital signal processor, wherein the external black side control elements are controlled by the black side human machine interface digital signal processor 324.

It is understood that the specific order or hierarchy of steps in the foregoing disclosed methods are examples of exemplary approaches. Based upon design preferences, it is understood that the specific order or hierarchy of steps in the method can be rearranged while remaining within the scope of the present invention. The accompanying method claims present elements of the various steps in a sample order, and are not meant to be limited to the specific order or hierarchy presented.

It is to be noted that the foregoing described embodiments according to the present invention may be conveniently implemented using conventional general purpose digital computers programmed according to the teachings of the present specification, as will be apparent to those skilled in the computer art. Appropriate software coding may readily be prepared by skilled programmers based on the teachings of the present disclosure, as will be apparent to those skilled in the software art.

It is to be understood that the present invention may be conveniently implemented in forms of a software package. Such a software package may be a computer program product which employs a computer-readable storage medium including stored computer code which is used to program a computer to perform the disclosed function and process of the present invention. The computer-readable medium may include, but is not limited to, any type of conventional floppy disk, optical disk, CD-ROM, magnetic disk, hard disk drive, magneto-optical disk, ROM, RAM, EPROM, EEPROM, magnetic or optical card, or any other suitable media for storing electronic instructions.

It is believed that the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A method for providing dynamic switching between red side control functionality and black side control functionality for a radio system, said method comprising:

providing a message from black side control elements of the radio system to a black side human machine interface digital signal processor, said message including a mode change request;

directing a communication, via a low voltage differential signaling interface, from the black side human machine interface digital signal processor to a protected core processor, the protected core processor being configured for hosting the red side control functionality, the communication informing the protected core processor of the mode change request;

sending a control transfer message, via a cryptographic sub-system, from the protected core processor to the black side human machine interface digital signal processor;

switching the black side control elements, wherein switching the black side control elements includes disconnecting the black side control elements from the black side human machine interface digital signal processor and connecting the black side control elements and the protected core processor via the low voltage differential signaling interface; and providing the red side control functionality for the radio system via the protected core processor, wherein the black side control elements are controlled by the protected core processor, wherein the black side human machine interface digital signal processor is placed into a low power operation mode when the black side control elements are controlled by the protected core processor.

2. A method as claimed in claim 1, further comprising:

initiating authentication over the low voltage differential, signaling interface, wherein the protected core processor initiates authentication with the black side control elements.

3. A method as claimed in claim 2, further comprising:

initiating an encrypted communication mode over the low voltage differential, signaling interface, wherein the encrypted communication mode is initiated by at least one of: the protected core processor and the black side control, elements.

4. A method as claimed in claim 3, wherein switching is performed by the black side human machine interface digital signal processor.

5. A method as claimed in claim 4, further comprising:

providing a mode change message from the black side control, elements of the radio system to the protected core processor.

6. A method as claimed in claim 5, further comprising:

disconnecting the black side control elements from the protected core processor and connecting the black side control elements to the black side human machine interface digital signal processor.

7. A method as claimed in claim 6, further comprising:

providing the black side control functionality for the radio system via the black side human machine interface digital signal processor, wherein the black side control elements are controlled by the black side human machine interface digital signal processor.

8. A computer program product, comprising:

a non-transitory signal-bearing medium bearing one or more instructions for performing a method for providing dynamic switching between red side control functionality and black side control functionality for a radio system, said method comprising:

providing a message from external black side control elements of the radio system to a black side human machine interface digital signal processor, said message including a mode change request;

directing a communication, via a low voltage differential signaling interface, from the black side human machine interface digital signal processor to a protected core processor, the protected core processor being configured for hosting the red side control functionality, the communication informing the protected core processor of the mode change request;

sending a control transfer message, via a cryptographic sub-system, from the protected core processor to the black side human machine interface digital signal processor;

switching the external black side control elements, wherein switching the external black side control elements includes disconnecting the external black side control elements from the black side human machine interface digital signal processor and connecting the external black side control elements and the protected core processor via the low voltage differential signaling interface; and providing the red side control functionality for the radio system via the protected core processor, wherein the external black side control elements are controlled by the protected core processor, wherein the black side human machine interface digital signal processor is placed into a low power operation mode when the black side control elements are controlled by the protected core processor.

9. A computer program product including a non-transitory signal-bearing medium bearing one or more instructions for performing a method as claimed in claim 8, said method further comprising:

initiating authentication over the low voltage differential signaling interface, wherein the protected core processor initiates authentication with the external, black side control elements.

10. A computer program product including a non-transitory signal-bearing medium bearing one or more instructions for performing a method as claimed in claim 9, said method further comprising:

initiating an encrypted communication mode over the low voltage differential signaling interface, wherein the encrypted communication mode is initiated by at least one of: the protected core processor and the external black side control elements.

11. A computer program product including a non-transitory signal-bearing medium bearing one or more instructions for performing a method as claimed in claim 10, said method further comprising:

providing a mode change message from the external black side control elements of the radio system to the protected core processor.

12. A computer program product including a non-transitory signal-bearing medium bearing one or more instructions for performing a method as claimed in claim 11, said method further comprising:

disconnecting the external black side control elements from the protected core processor and connecting the external black side control elements to the black side human machine interface digital signal processor.

13. A computer program product including a non-transitory signal-bearing medium bearing one or more instructions for performing a method as claimed in claim 12, said method further comprising:

providing the black side control functionality for the radio system via the black side human machine interface digital signal processor, wherein the external black side control elements are controlled by the black side human machine interface digital signal processor.

* * * * *